US007958970B2

(12) United States Patent
Ma et al.

(10) Patent No.: US 7,958,970 B2
(45) Date of Patent: Jun. 14, 2011

(54) ACCELERATION SENSOR CALIBRATED HOIST POSITIONING

(75) Inventors: Pengfei Ma, Henan (CN); Shihan Zhang, Henan (CN)

(73) Assignee: Empire Technology Development LLC, Wilmington, DE (US)

( * ) Notice: Subject to any disclaimer, the term of this patent is extended or adjusted under 35 U.S.C. 154(b) by 20 days.

(21) Appl. No.: 12/553,091

(22) Filed: Sep. 2, 2009

(65) Prior Publication Data

US 2011/0048861 A1 Mar. 3, 2011

(51) Int. Cl.
*B66B 3/02* (2006.01)

(52) U.S. Cl. ..... 187/394; 187/283

(58) Field of Classification Search ..... 187/247, 187/282–284, 291, 293, 296, 297, 391–394
See application file for complete search history.

(56) References Cited

U.S. PATENT DOCUMENTS

| | | | | |
|---|---|---|---|---|
| 4,880,082 | A * | 11/1989 | Kahkipuro et al. | 187/394 |
| 5,883,345 | A * | 3/1999 | Schonauer et al. | 187/394 |
| 6,446,761 | B1 * | 9/2002 | Motoyama et al. | 187/391 |
| 6,467,585 | B1 * | 10/2002 | Gozzo et al. | 187/391 |
| 6,732,839 | B2 * | 5/2004 | Schuster | 187/391 |
| 7,077,244 | B2 * | 7/2006 | Oh et al. | 187/394 |
| 7,143,001 | B2 * | 11/2006 | Karasek | 702/141 |
| 7,353,916 | B2 * | 4/2008 | Angst | 187/393 |
| 7,484,598 | B2 * | 2/2009 | Tyni et al. | 187/393 |
| 7,540,358 | B2 * | 6/2009 | Okamoto et al. | 187/394 |
| 7,703,579 | B2 * | 4/2010 | Tyni et al. | 187/393 |

* cited by examiner

*Primary Examiner* — Jonathan Salata
(74) *Attorney, Agent, or Firm* — Ren-Sheng International

(57) ABSTRACT

A hoist positioning system includes an accelerometer attached to a hoist, a control unit for processing signals from the accelerometer and comparing the processed signals with reference data to determine a position of the hoist, a drive system for moving the hoist up and down, and a relay that is switched ON and OFF by a control signal from the control unit. When the relay is switched ON, power is supplied to the drive system from a high-voltage power source and the hoist is driven up or down. When the relay is switched OFF, power from the high-voltage power source to the drive system is cut off and the hoist stops moving up or down.

20 Claims, 4 Drawing Sheets

ACCELERATION SENSOR CALIBRATED HOIST POSITIONING

BACKGROUND

Unless otherwise indicated herein, the approaches described in this section are not prior art to the claims in this application and are not admitted to be prior art by inclusion in this section.

A hoist is a mechanism for lifting loads. It is used in large scale construction projects to convey building materials, equipment and workers quickly between ground and higher floors, and between floors. A hoist generally includes one or two cars that travel vertically along stacked mast sections using a motorized rack-and-pinion system. The cars are equipped with a high-power voltage source that supplies power to the motorized pinion of the rack-and-pinion system. The positioning of a hoist is performed using a lever that has different positions. In one lever position, the hoist is moved up. In another position, the hoist is moved down.

BRIEF DESCRIPTION OF THE DRAWINGS

The foregoing and other features of the present disclosure will become more fully apparent from the following description and appended claims, taken in conjunction with the accompanying drawings. These drawings depict only several embodiments in accordance with the disclosure and are, therefore, not to be considered limiting of its scope. The disclosure will be described with additional specificity and detail through use of the accompanying drawings.

In the drawings.

DETAILED DESCRIPTION

Figure 1:
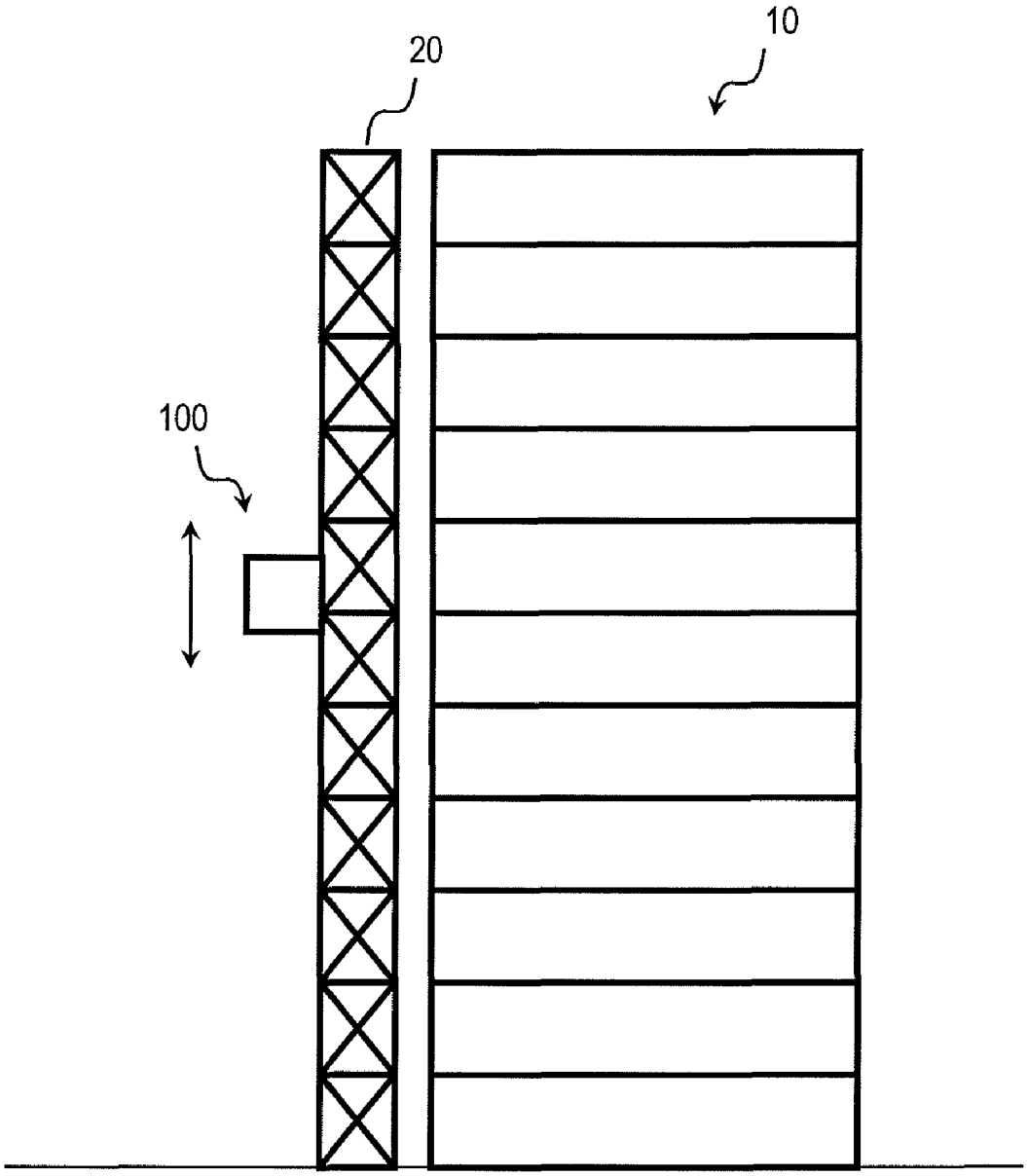
FIG. 1 illustrates a hoist system according to an embodiment of the present disclosure in relation to a multi-level building being constructed.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn, inter alia, to a hoist positioning system and method. A hoist positioning system, according to an embodiment of this disclosure, includes an accelerometer attached to a hoist, a control unit for processing signals from the accelerometer and comparing the processed signals with reference data to determine a position of the hoist, a drive system for moving the hoist up and down, and a relay that is switched ON and OFF by a control signal from the control unit. When the relay is switched ON, power is supplied to the drive system from a high-voltage power source and the hoist is driven up or down. When the relay is switched OFF, power from the high-voltage power source to the drive system is cut off and the hoist stops moving up or down.

FIG. 1 illustrates a hoist system according to an embodiment of the present disclosure in relation to a multi-level building being constructed. Multi-level building 10 is being constructed to have multiple floors. A mast section 20 is positioned adjacent to multi-level building 10 to provide support for hoist 100, which travels up and down along mast section 20 to convey building materials, equipment and workers quickly between ground and higher floors of multi-level building 10, and between floors of multi-level building 10.

Figure 2:
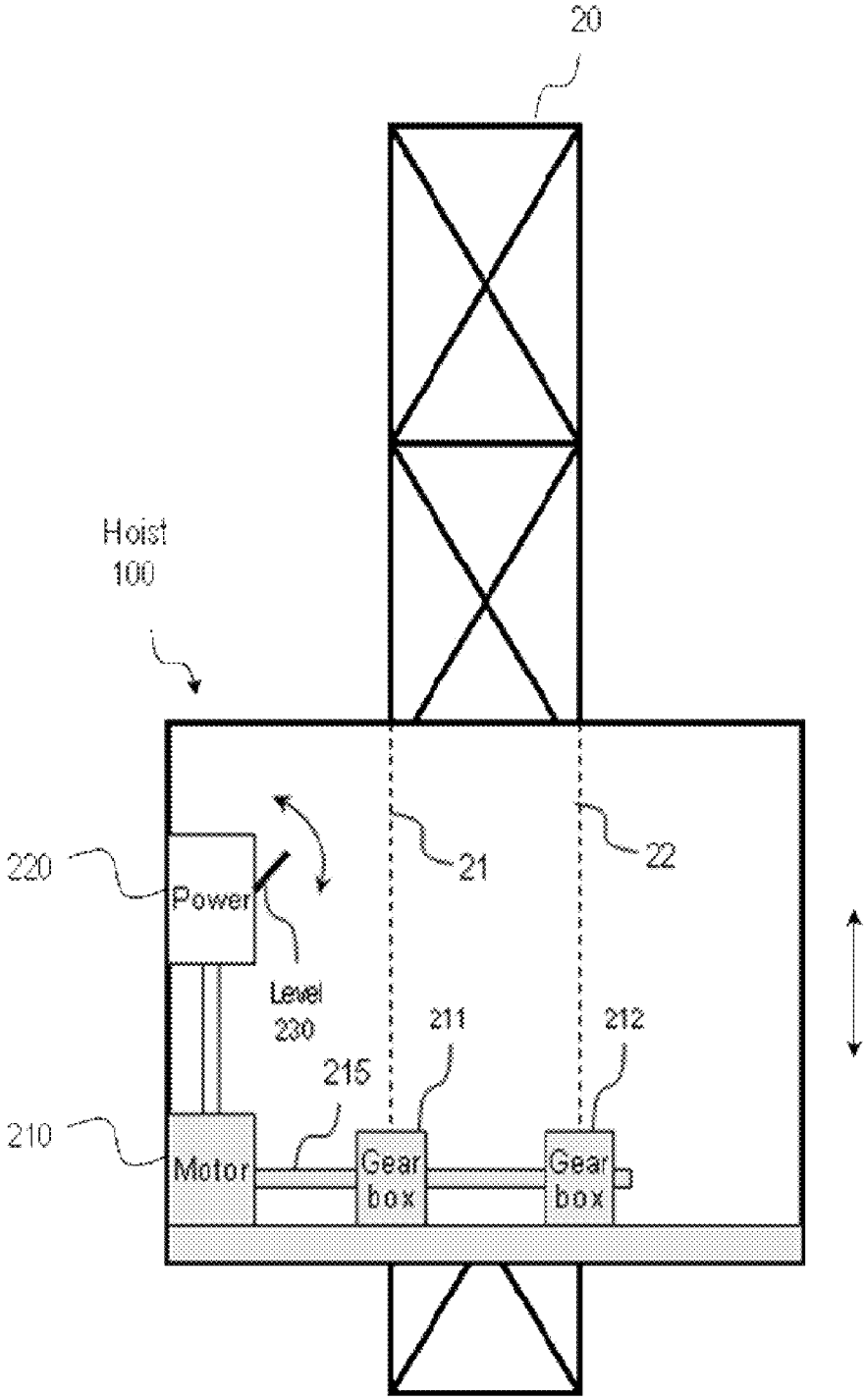
FIG. 2 illustrates a hoist mounted to travel along parallel rails of a mast section and the hoist's drive system.

FIG. 2 illustrates a hoist mounted to travel along parallel rails of a mast section and the hoist's drive system. Mast section 20 (only a portion of is shown in FIG. 2) includes a first rail 21 and a second rail 22 along which hoist 100 travels through a rack-and-pinion system. The rack gears are provided on first rail 21 and second rail 22. The pinion gears are provided in gearboxes 211, 212. A motor 210 drives the pinion gears through a shaft 215 and is powered by a high-voltage power source contained in box 220. When motor 210 turns in a first direction, hoist 100 moves up the rails. When motor 220 turns in a second direction that is opposite to the first direction, hoist 100 moves down the rails. When motor 220 is not powered to turn in either direction, a brake system (not shown) holds hoist 100 in place against the force of gravity. A lever 230 can be operated in either the up direction to turn motor 220 in the first direction or the down direction to turn motor 220 in the second direction. When lever 230 is in its neutral position (neither up nor down), power is not supplied to motor 220 and the brake system holds hoist 100 in place against the force of gravity.

Figure 3:
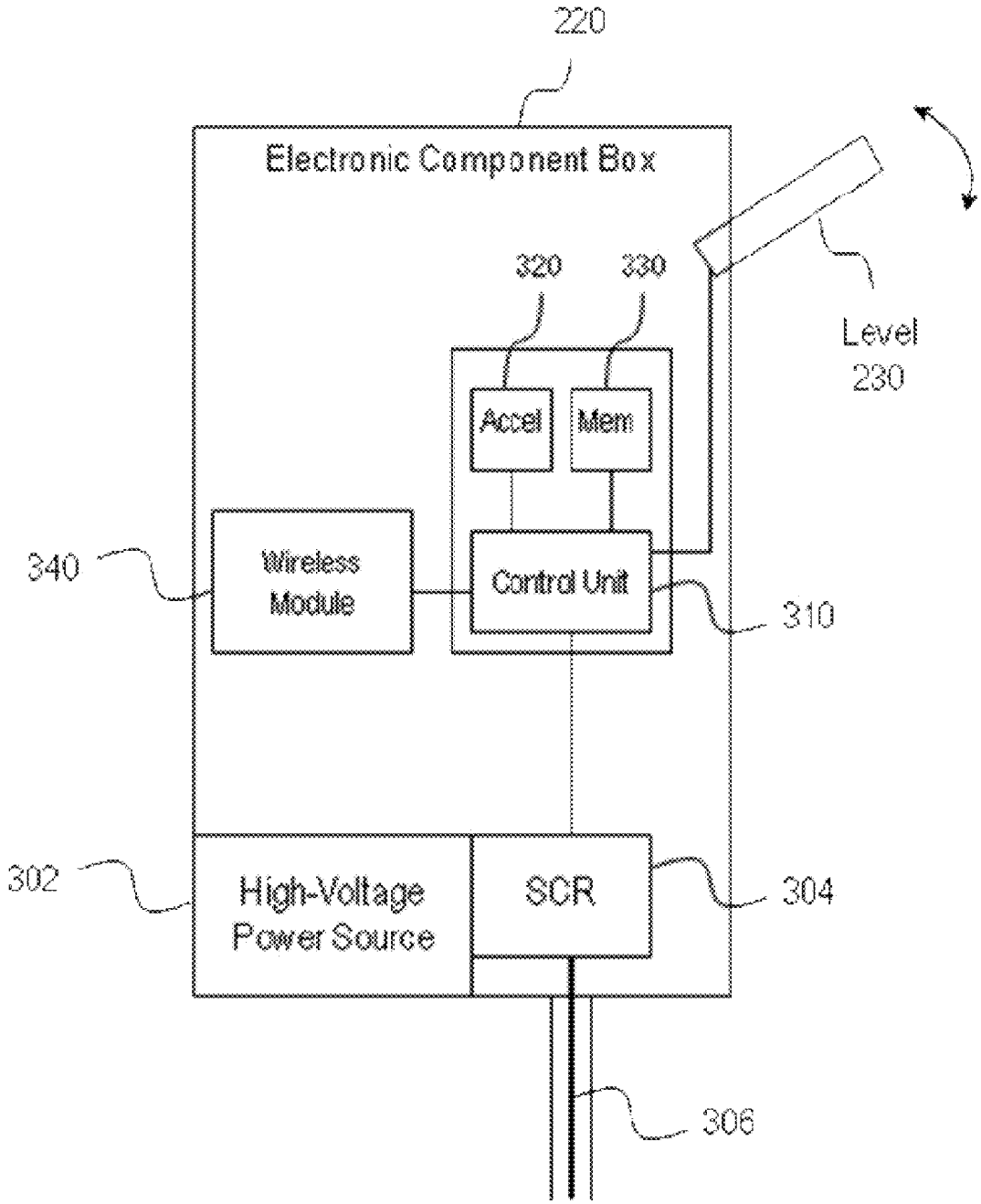
FIG. 3 is a block diagram of electrical components of the hoist of FIG. 2.

FIG. 3 is a block diagram of electrical components of the hoist of FIG. 2. The electrical components are housed inside box 220 and include a high-voltage power source 302 that supplies power through an SCR 304 (or more generally, a relay), and high voltage line 306. SCR 304 is controlled ON or OFF by a low voltage signal coming from control unit 310. With this configuration, a high voltage system can be controlled using low voltages to increase operator safety. An example low voltage may be 5 volts, and an example high voltage in powering hoists may be 380 volts. Control unit 310 is a programmable single-chip microcomputer. It is programmed to process voltage signals from accelerometer 320, read and write data from and to memory unit 330, and communicate with wireless module 340. Accelerometer 320 senses the up/down accelerations of hoist 100 and outputs a voltage signal having a voltage level that corresponds to the sensed acceleration to control unit 310. Wireless module 340 includes an infrared (IR) receiver for receiving control inputs from a remote control that is equipped with a corresponding IR transmitter, and an RF transceiver for communicating with a base unit in a control room.

Control unit 310 operates in either a calibration mode or an operation mode. The remote control includes a mode-selection button that switches control unit 310 between the calibration mode and the operation mode. During the calibration mode, hoist 100 is positioned manually at each building level, and the voltage signals output from accelerometer 320 during this process are processed by control unit 310 and the processed signals are recorded in memory 330. During the operation mode, hoist 100 is moved to a particular building level by comparing voltage signals output from accelerometer 320 during movement, against the recorded data.

Figure 4:
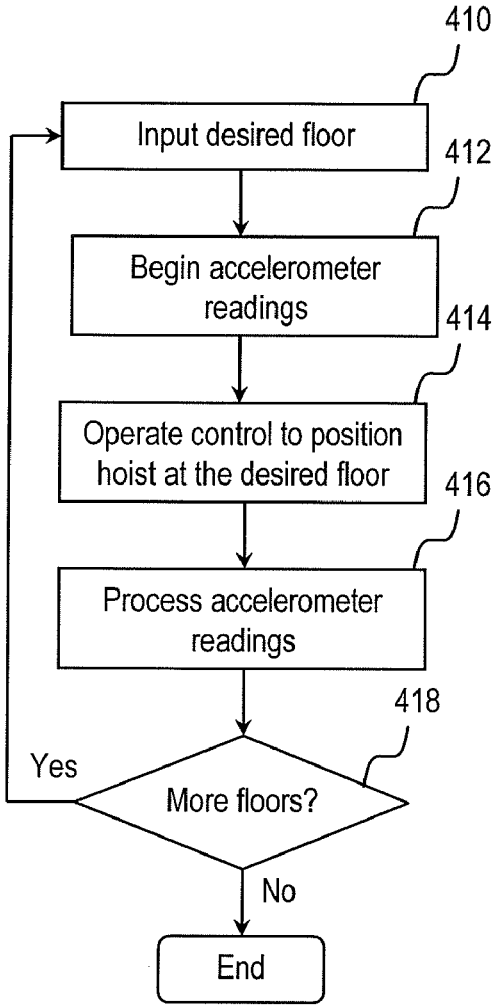
FIG. 4 is a flow diagram illustrating a process for calibrating the hoist of FIG. 2 for vertical positioning.

FIG. 4 is a flow diagram illustrating a process for calibrating the hoist of FIG. 2 for vertical positioning. The process begins at Operation 410 with a desired floor level for hoist 100 inputted through the remote control. Then at Operation 412, control unit 310 begins processing of voltage signals that are output from accelerometer 320. At operation 414, via a relay, such as SCR 304, control unit 310 causes lever 230 to move hoist 100 to the desired floor level (Operation 414). The processing of voltage signals is ended at Operation 416 after the desired floor has been reached. If there are additional floors to be calibrated (Operation 418), the process flow returns to Operation 410. Operations 410, 412, 414, 416 are repeated until all building floors have been accounted for.

Figure 5:
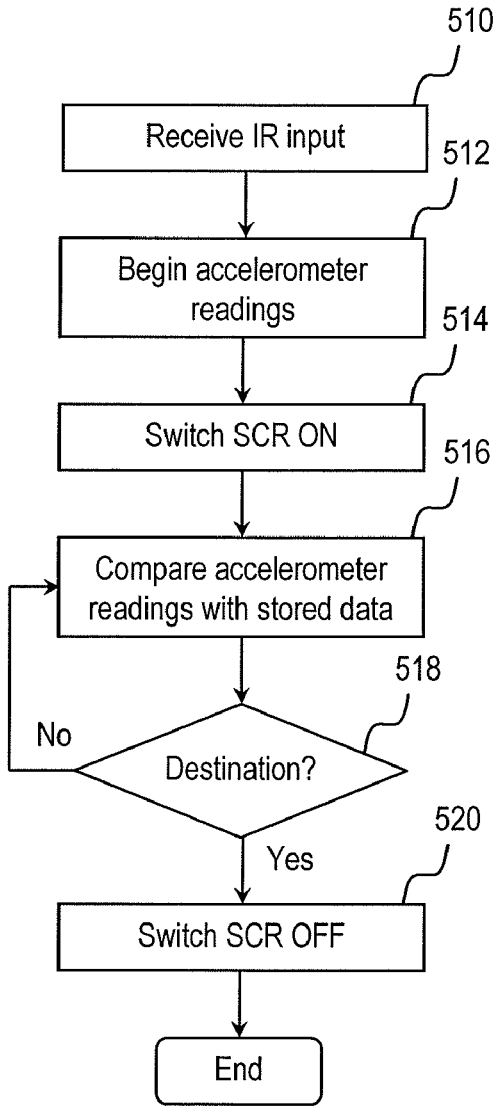
FIG. 5 is a flow diagram illustrating a process for positioning the hoist of FIG. 2, all arranged in accordance with at least some embodiments of the present disclosure.

FIG. 5 is a flow diagram illustrating a process for positioning the hoist of FIG. 2. This process is carried out by control unit 310 and begins at Operation 510 with the receipt of a remote control input indicating a destination floor. Then, at Operation 512, control unit 310 begins processing of voltage signals that are output from accelerometer 320. SCR 304 is switched ON at Operation 514. This is done by a low voltage signal output by control unit 310. When SCR 304 is switched ON, power is supplied to motor 210 from high voltage power source 302. In addition to power, a control signal is output to motor 210 to control the direction of the motor rotation. As hoist 100 is moved, control unit 310 continuously processes the voltage signals that are output from accelerometer 320 and compares them with the recorded data (Operation 516) to determine whether or not the destination floor has been reached (Operation 518). If the destination floor has been reached, SCR 304 is switched OFF to cut off power to motor 210 (Operation 520). This is also done by a low voltage signal output by control unit 310. If the destination floor has not been reached, control unit 310 continues to process the voltage signals that are output from accelerometer 320 and compares them with the recorded data.

In an alternative embodiment, hoist position calibration and control can be performed remotely in a control room through wireless module 340. Also, control unit 310 and memory 330 can be removed from box 220 and placed in the control room. This configuration avoids data cable placements in the hoists, and can be implemented as a standalone module, which is beneficial when modifying existing hoists. It is also easy and convenient to use.

With the hoist positioning system and method described above, hoists can be positioned precisely and automatically, and even from a remote location, if so desired. As a result, accurate hoist positioning becomes possible even in dark environments and low visibility weather conditions. With the hoist positioning system and method described above, training of hoist operators also becomes easier and safer.

There is little distinction left between hardware and software implementations of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A hoist positioning system comprising:

an accelerometer attached to a hoist;

a control unit for processing signals from the accelerometer and comparing the processed signals with calibration data to determine a position of the hoist, wherein in a calibration mode, the control unit calibrates readings from the accelerometer to different vertical positions of the hoist as the calibration data;

a drive system for moving the hoist up and down; and a relay that is switched ON or OFF by a control signal from the control unit, wherein when the relay is switched ON, power is supplied to the drive system and when the relay is switched OFF, power to the drive system is cut off.

2. The hoist positioning system according to claim 1, further comprising an infrared receiver for receiving a destination floor input from a remote infrared transmitter, wherein the control unit sends a control signal to switch OFF the relay when the control unit determines that the destination floor has been reached.

3. The hoist positioning system according to claim 1, further comprising a wireless transceiver for communicating with a base unit in a control room.

4. The hoist positioning system according to claim 1, further comprising a wireless receiver for communicating with a base unit in a control room, wherein when a destination floor input is received from the base unit through the wireless receiver, the control unit sends a control signal to switch OFF the relay when the control unit determines that the destination floor has been reached.

5. The hoist positioning system according to claim 1, wherein the control unit is mounted to the hoist.

6. The hoist positioning system according to claim 1, wherein the control unit is operable in the calibration mode and an operation mode.

7. The hoist positioning system according to claim 1, wherein the relay is an SCR.

8. A hoist positioning system comprising:

an accelerometer attached to a hoist;

a drive system for moving the hoist up and down; and a control unit for issuing signals to control the drive system, the control unit operable in a calibration mode and an operation mode, wherein, in the calibration mode, the control unit calibrates first readings from the accelerometer to different vertical positions of the hoist as calibration data, in the operation mode, the control unit moves the hoist to a particular vertical position based on second readings from the accelerometer and the calibration data.

9. The hoist positioning system according to claim 8, further comprising an infrared receiver for receiving a destination floor input from a remote infrared transmitter, wherein the control unit moves the hoist to the destination floor based on the second readings from the accelerometer and the calibration data.

10. The hoist positioning system according to claim 8, further comprising a high-voltage power source for the drive system.

11. The hoist positioning system according to claim 8, further comprising a relay that is switched ON or OFF by a control signal from the control unit, wherein when the relay is switched ON, power is supplied from the high-voltage power source to the drive system and when the relay is switched OFF, power from the high-voltage power source to the drive system is cut off.

12. The hoist positioning system according to claim 8, wherein the relay is an SCR.

13. The hoist positioning system according to claim 8, further comprising a wireless transceiver for communicating with a base unit in a control room.

14. The hoist positioning system according to claim 8, further comprising a wireless receiver for communicating with a base unit in a control room, wherein when a destination floor input is received from the base unit through the wireless receiver, the control unit sends a control signal to switch OFF the relay when the control unit determines that the destination floor has been reached.

15. A hoist positioning method comprising:

controlling a hoist to different vertical positions and calibrating first readings from the accelerometer to different vertical positions of the hoist as calibration data;

receiving a destination vertical position for the hoist; and moving the hoist to the destination vertical position based on second readings from the accelerometer and the calibration data.

16. The hoist positioning method according to claim 15, wherein moving the hoist to the destination vertical position includes switching ON a relay to cause power from a high voltage power source to be supplied to a drive system for the hoist.

17. The hoist positioning method according to claim 15, wherein moving the hoist to the destination vertical position includes switching ON a relay to cause power from a high voltage power source to be supplied to a drive system for the hoist, and switching OFF the relay when the destination vertical position has been reached.

18. The hoist positioning method according to claim 15, wherein moving the hoist to the destination vertical position includes determining if the destination vertical position has been reached based on a comparison of the second readings from the accelerometer with the calibration data.

19. The hoist positioning method according to claim 15, wherein the destination vertical position for the hoist is received from an input device operated on the hoist.

20. The hoist positioning method according to claim 15, wherein the destination vertical position for the hoist is received from an input device operated in a control room remote from the hoist.

* * * * *